US012070166B2

(12) United States Patent
Sun

(10) Patent No.: US 12,070,166 B2
(45) Date of Patent: Aug. 27, 2024

(54) TOILET SEAT RING

(71) Applicant: Shanghai Kohler Electronics, Ltd., Shanghai (CN)

(72) Inventor: Xiaoquan Sun, Shanghai (CN)

(73) Assignee: Shanghai Kohler Electronics, Ltd., Shanghai (CN)

( * ) Notice: Subject to any disclaimer, the term of this patent is extended or adjusted under 35 U.S.C. 154(b) by 25 days.

(21) Appl. No.: 18/085,623

(22) Filed: Dec. 21, 2022

(65) Prior Publication Data

US 2023/0301471 A1 Sep. 28, 2023

(30) Foreign Application Priority Data

Dec. 27, 2021 (CN) ..... 202123317369.X

(51) Int. Cl.
*A47K 13/26* (2006.01)
*A47K 13/02* (2006.01)

(52) U.S. Cl.
CPC ..... *A47K 13/26* (2013.01); *A47K 13/02* (2013.01)

(58) Field of Classification Search
CPC ..... A47K 13/26; A47K 13/02; A47K 13/12; A47K 13/30; E03D 9/03
See application file for complete search history.

(56) References Cited

U.S. PATENT DOCUMENTS 6,675,399 B1 * 1/2004 Tomita ..... E03D 9/08 4/422
9,015,869 B2 4/2015 Henderson
9,801,508 B1 10/2017 Hall et al.
9,834,917 B2 12/2017 Moore

FOREIGN PATENT DOCUMENTS

| | | | |
|---|---|---|---|
| AU | 2021103694 | A4 | 8/2021 |
| CN | 110130453 | A | 8/2019 |
| CN | 211751412 | U | 10/2020 |
| CN | 216739898 | U | 6/2022 |
| CN | 115736690 | A | 3/2023 |
| CN | 218978748 | U | 5/2023 |
| CN | 219109291 | U | 6/2023 |
| DE | 202016001061 | U1 | 2/2017 |

(Continued)

OTHER PUBLICATIONS

Extended European Search Report from European Application No. 22216424.6, dated May 30, 2023, 8 pages.

*Primary Examiner* — Christine J Skubinna
(74) *Attorney, Agent, or Firm* — Lempia Summerfield Katz LLC

(57) ABSTRACT

A toilet seat ring includes: a seat ring body and a seat ring mounting end configured to be connected to the seat ring body. The seat ring mounting end includes: a mounting hole configured to install a pivot shaft; and a mounting cavity connected to the mounting hole. The toilet seat ring also includes a sealing element configured to be disposed in the seat ring mounting end. The sealing element includes: an assembly portion configured to be disposed in the mounting cavity; and a plugging portion connected to the assembly portion and configured to seal the mounting hole. The plugging portion includes a wiring harness assembly hole and at least one water pipe mounting hole spaced apart from the wiring harness assembly hole.

20 Claims, 7 Drawing Sheets

(56) References Cited

FOREIGN PATENT DOCUMENTS

| | | | | |
|---|---|---|---|---|
| JP | 6022505 | B2 | | 10/2016 |
| KR | 100736871 | B1 | | 7/2007 |
| KR | 20130046343 | A | | 5/2013 |
| KR | 101546066 | B1 | | 8/2015 |
| KR | 20170032119 | A | * | 3/2017 |
| KR | 20170032119 | A | | 3/2017 |
| KR | 102460120 | B1 | | 10/2022 |

* cited by examiner

TOILET SEAT RING

CROSS REFERENCE TO RELATED APPLICATION

This application claims the benefit of priority to: Chinese Patent Application No. 202123317369.X filed in the Chinese Intellectual Property Office on Dec. 27, 2021, which is hereby incorporated by reference in its entirety.

FIELD

The present disclosure relates to the field of toilet bidet technologies, and particularly to a seat ring.

BACKGROUND

Current smart toilets may be provided with an electrical control wiring harness and water pipes. A rear portion of a seat ring of the smart toilet may be provided with a nozzle structure. The nozzle structure needs to be connected with an external power supply through the wiring harness. The nozzle structure also needs to be connected with the water pipe to spray water.

A through hole is needed to be specially formed in the seat ring to mount the above the wiring harness and water pipes. Thus, the seat ring has a complex structure, and it is inconvenient to assemble the seat ring.

In view of the above technical problem, it is necessary to provide a seat ring with simplified structure and convenient assembly.

SUMMARY

The present disclosure aims to overcome the defects in the current seat ring and provide a seat ring capable of simplifying a structure of the seat ring and facilitating assembly.

The present disclosure provides a seat ring, which comprises a seat ring body, a seat ring mounting end connected at a rear end of the seat ring body, and a flexible sealing element mounted in the seat ring mounting end.

A mounting hole configured to mount a pivot shaft is arranged in the seat ring mounting end, and a mounting cavity communicated with the mounting hole is arranged in the seat ring mounting end.

The flexible sealing element comprises an assembly portion and a plugging portion connected with the assembly portion.

The assembly portion is mounted in the mounting cavity, and the plugging portion is sealed in the mounting hole; and The plugging portion is provided with a wiring harness assembly hole and a water pipe mounting hole, and the water pipe mounting hole is located below the wiring harness assembly hole.

In an embodiment, a wiring harness assembly channel is arranged between a surface of the plugging portion and the wiring harness assembly hole, and a water pipe assembly channel is arranged between an outer surface of the plugging portion and the water pipe mounting hole.

In an embodiment, openings of the wiring harness assembly channel and the water pipe assembly channel are both located at a rear end of the plugging portion.

In an embodiment, the plugging portion is provided with two water pipe mounting holes arranged at an interval front and back.

In an embodiment, a communication channel is arranged between the two water pipe mounting holes.

In an embodiment, the plugging portion is integrally formed with the assembly portion.

In an embodiment, the flexible sealing element is a silicone sealing element.

In an embodiment, the seat ring mounting end comprises a mounting end lower cover and a mounting end upper cover. A rear end of the mounting end lower cover is provided with an arc-shaped lower cover groove, and a rear end of the mounting end upper cover is provided with an arc-shaped upper cover groove.

The mounting end upper cover is welded with the mounting end lower cover, and the upper cover groove is butted with or connected to the lower cover groove to form the mounting hole. In an embodiment, the mounting end upper cover and/or the mounting end lower cover is provided with a limiting plate extending into the mounting cavity, the assembly portion is provided with a limiting groove, and the limiting plate is inserted into the limiting groove.

In an embodiment, the seat ring body comprises a body upper cover and a body lower cover.

The mounting end upper cover and the body upper cover are integrally formed into a seat ring upper cover, and the mounting end lower cover and the body lower cover are integrally formed into a seat ring lower cover; and The seat ring upper cover is welded with the seat ring lower cover.

By adopting the technical solutions above, the present disclosure has the following beneficial effects.

According to the seat ring provided by the present disclosure, the flexible sealing element is mounted in the seat ring mounting end. A half portion on an outer side of the mounting hole in the seat ring mounting end is sealed by the plugging portion. The plugging portion is provided with the wiring harness assembly hole and the water pipe mounting hole. A wiring harness and a water pipe can enter an inner side of the seat ring through the wiring harness assembly hole and the water pipe mounting hole respectively, without needing to separately form a through hole in the seat ring. Such a configuration may simplify the structure of the seat ring and facilitate the assembly of the wiring harness and the water pipe. The water pipe and the wiring harness are separated from each other without mutual interference. Thus, the stability of the structure may be improved.

BRIEF DESCRIPTION OF THE FIGURES

With reference to the drawings, the contents disclosed by the present disclosure should be more easily understood. It should be understood that these drawings are merely used for illustration and are not intended to limit the protection scope of the present disclosure. In the drawings.

DETAILED DESCRIPTION

Figure 1:
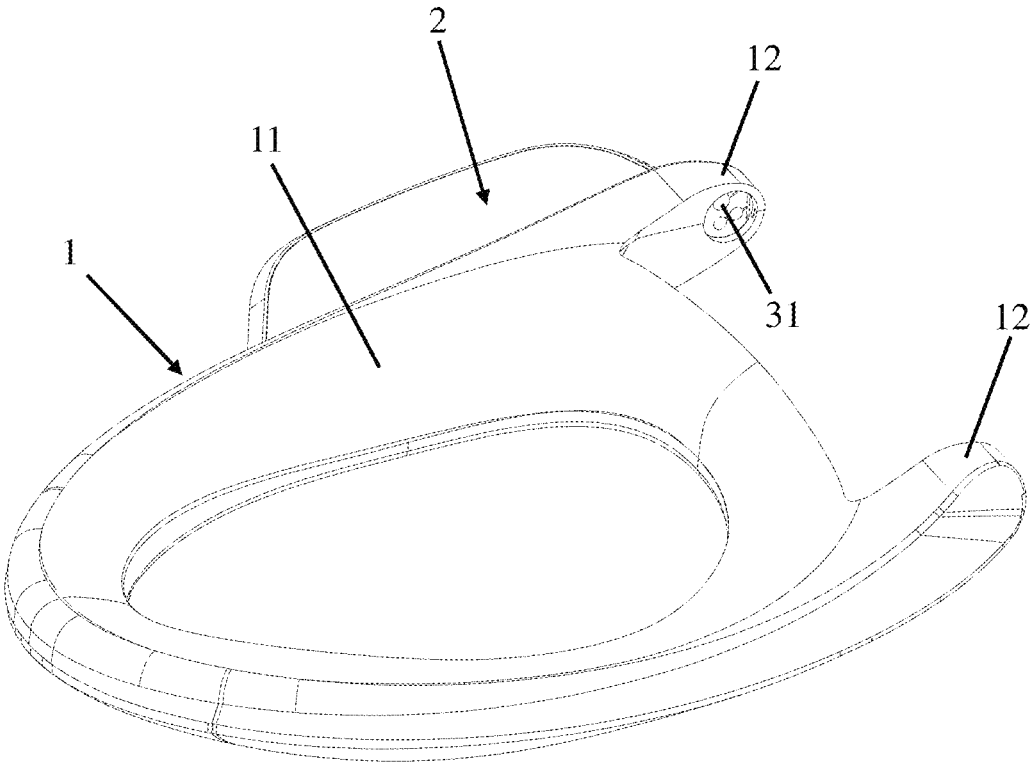
FIG. 1 is a perspective view of a seat ring according to an example of the present disclosure.
Figure 2:
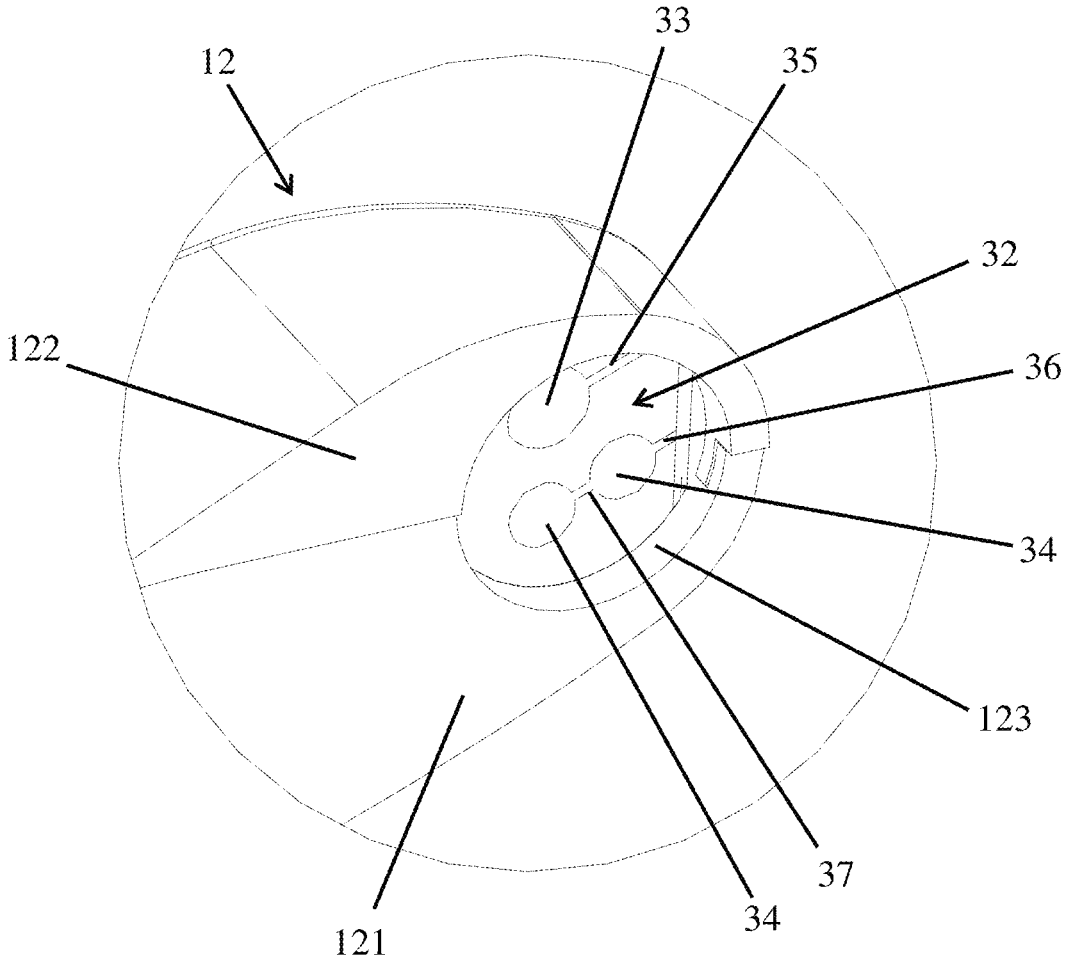
FIG. 2 is an enlarged view of a seat ring mounting end.

The specific embodiments of the present disclosure are further described with reference to the drawings hereinafter. Same or equivalent parts are denoted by same reference numerals. It should be noted that the terms "front", "back", "left", "right", "up" and "down" used in the following description refer to the directions in the drawings, and the terms "inner" and "outer" refer to the directions towards or far away from geometric centers of specific parts respectively.

As shown in FIG. 1-FIG. 8, an embodiment of the present disclosure provides a seat ring 1, which comprises a seat ring body 11, a seat ring mounting end 12 connected to a rear end of the seat ring body 11, and a flexible sealing element 3 mounted in the seat ring mounting end 12.

A mounting hole 123 configured to mount a pivot shaft is arranged in the seat ring mounting end 12, and a mounting cavity 124 communicated to the mounting hole 123 is arranged in the seat ring mounting end 12.

The flexible sealing element 3 comprises an assembly portion 31 and a plugging portion 32 connected to the assembly portion 31.

The assembly portion 31 is mounted in the mounting cavity 124, and the plugging portion 32 seals the mounting hole 123.

The plugging portion 32 is provided with a wiring harness assembly hole 33 and a water pipe mounting hole 34, and the water pipe mounting hole 34 is located below the wiring harness assembly hole 33.

The present disclosure provides the seat ring 1, and a side portion of the seat ring is provided with a control panel 2. The seat ring 1 comprises the seat ring body 11 and two seat ring mounting ends 12. The seat ring body 11 has an annular shape. The two seat ring mounting ends 12 are configured to be assembled with the pivot shaft. The mounting hole 123 assembled with the pivot shaft is disposed in the seat ring mounting end 12. One flexible sealing element 3 may be assembled in each of the two seat ring mounting ends 12 or the seat ring mounting end 12 close to the control panel 2 as needed. Also, the mounting cavity 124 is arranged in the seat ring mounting end 12, and the mounting cavity 124 is connected to the mounting hole 123.

The flexible sealing element 3 is a rubber sealing element or a silicone sealing element and comprises the assembly portion 31 and the plugging portion 32. The plugging portion 32 is connected to the assembly portion 31. The assembly portion 31 is configured for assembly and is mounted or installed in the mounting cavity 124. The plugging portion 32 is configured to plug or block the mounting hole 123, and the plugging portion 32 is located in the mounting hole 123 to plug the mounting hole 123. A thickness of the plugging portion 32 is smaller than a width of the mounting hole 123 along an axial direction. The plugging portion 32 is close to an outside opening of the mounting hole 123.

In order to facilitate the mounting of the wiring harness and the water pipe, the plugging portion 32 is provided with the wiring harness assembly hole 33 and the water pipe mounting hole 34, and the water pipe mounting hole 34 is located below the wiring harness assembly hole 33.

During assembly, the wiring harness of the control panel 2 passes through the wiring harness assembly hole 33, and the water pipe passes through the water pipe mounting hole 34. The wiring harness and the water pipe may both pass through the mounting hole 123, without a need to separately form a through hole in the seat ring. Thus, a structure of the seat ring may be simplified. The plugging portion 32 may not only seal the mounting hole 123, but also separate the wiring harness from the water pipe so as to facilitate the assembly of the wiring harness and the water pipe. The water pipe and the wiring harness are separated from each other, without mutual interference, and thus a stability of the structure may be improved.

In an embodiment, as shown in FIG. 2, FIG. 3, FIG. 4, and FIG. 7, a wiring harness assembly channel 35 is arranged between a surface of the plugging portion 32 and the wiring harness assembly hole 33, and a water pipe assembly channel 36 is arranged between an outer surface of the plugging portion 32 (or the same surface where the wiring harness assembly channel 35 is disposed) and the water pipe mounting hole 34.

During mounting, the wiring harness is inserted into the wiring harness assembly hole 33 through the wiring harness assembly channel 35, and the water pipe is inserted into the water pipe mounting hole 34 through the water pipe assembly channel 36. Then, the flexible sealing element 3 installed with the wiring harness and the water pipe is assembled to a designated position in the seat ring mounting end 12.

A width of the wiring harness assembly channel 35 is smaller than a diameter of the wiring harness assembly hole 33, and a width of the water pipe assembly channel 36 is smaller than a diameter of the water pipe mounting hole 34. The plugging portion 32 has a flexible structure. When the wiring harness or the water pipe is mounted, the wiring harness assembly channel 35 and the water pipe assembly channel 36 may be expanded. After the wiring harness and the water pipe are mounted in place, the wiring harness assembly channel 35 and the water pipe assembly channel 36 automatically reset to an initial state.

In an embodiment, as shown in FIG. 2, FIG. 3, FIG. 4, and FIG. 7, openings of the wiring harness assembly channel 35 and the water pipe assembly channel 36 are both located at a rear end of the plugging portion 32, and the opening of the wiring harness assembly channel 35 is located above the opening of the water pipe assembly channel 36, so that the wiring harness assembly channel 35 and the water pipe assembly channel 36 will not intersect. After mounting in place, the openings of the wiring harness assembly channel 35 and the water pipe assembly channel 36 are blocked by a wall of the mounting hole 123.

In an embodiment, as shown in FIG. 2, FIG. 3, FIG. 4, and FIG. 7, the plugging portion 32 is provided with two water pipe mounting holes 34 spaced apart from with each other along a front and back direction. A hot water pipe and a cold water pipe may be respectively disposed in the two water pipe mounting holes 34 if needed. Thus, different mounting requirements may be met.

Figure 3:
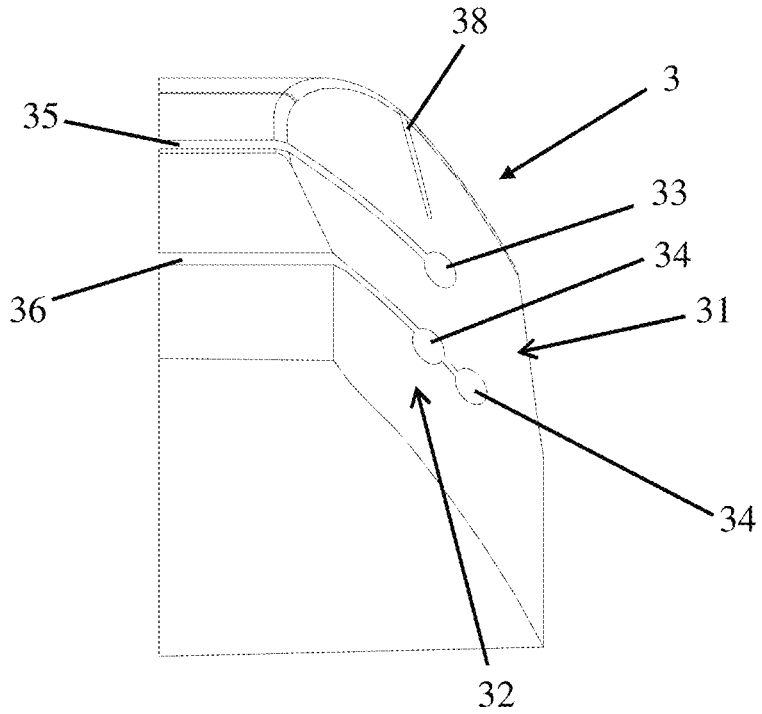
FIG. 3 is a perspective view of a flexible sealing element.
Figure 4:
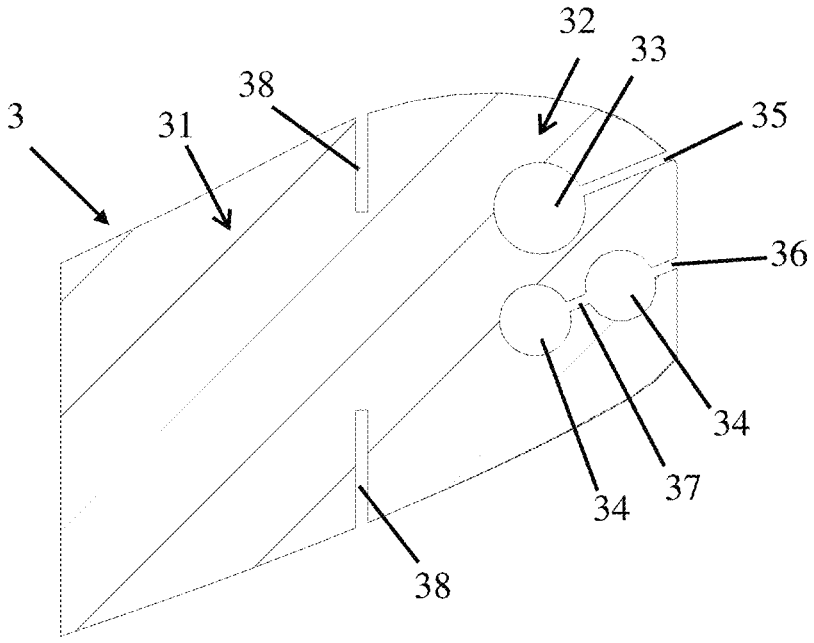
FIG. 4 is a sectional view of the flexible sealing element.
Figure 5:
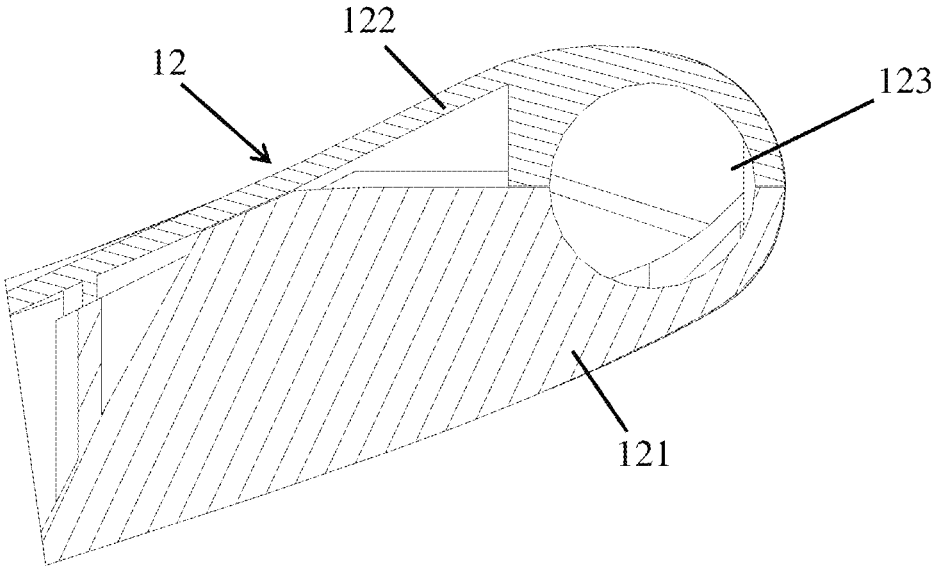
FIG. 5 is a sectional view of the seat ring mounting end along a radial direction of a mounting hole.
Figure 6:
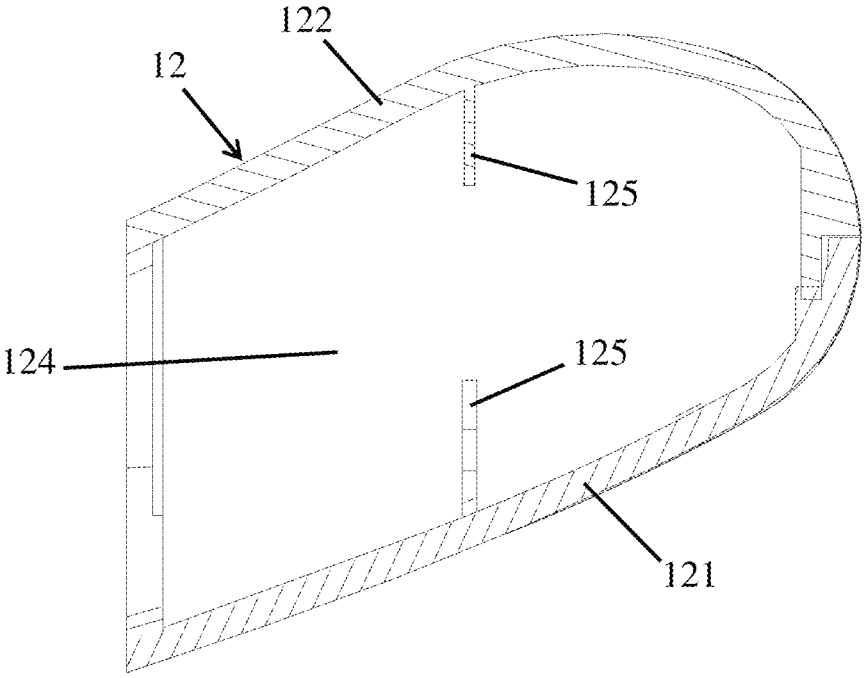
FIG. 6 is a sectional view of the seat ring mounting end along a mounting cavity.
Figure 7:
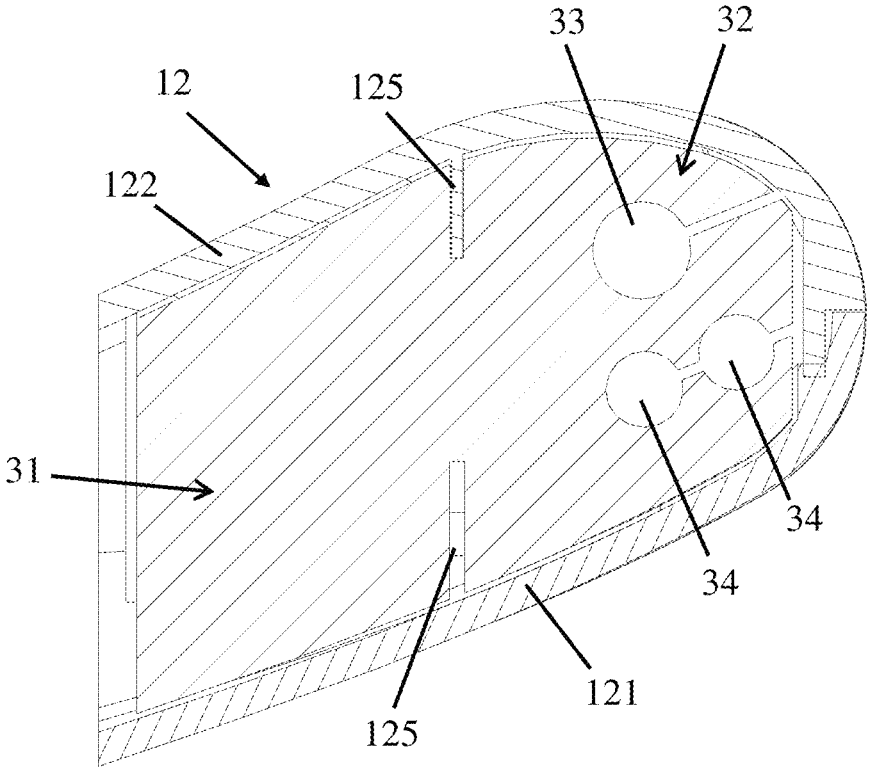
FIG. 7 is a schematic diagram of the flexible sealing element mounted between a mounting end upper cover and a mounting end lower cover.
Figure 8:
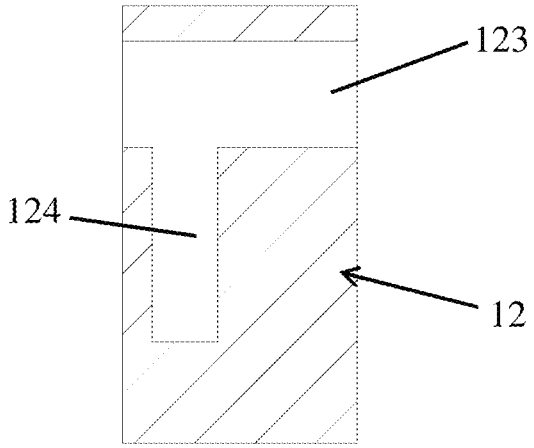
FIG. 8 is a sectional view of the seat ring mounting end along an axial direction of the mounting hole.
Figure 9:
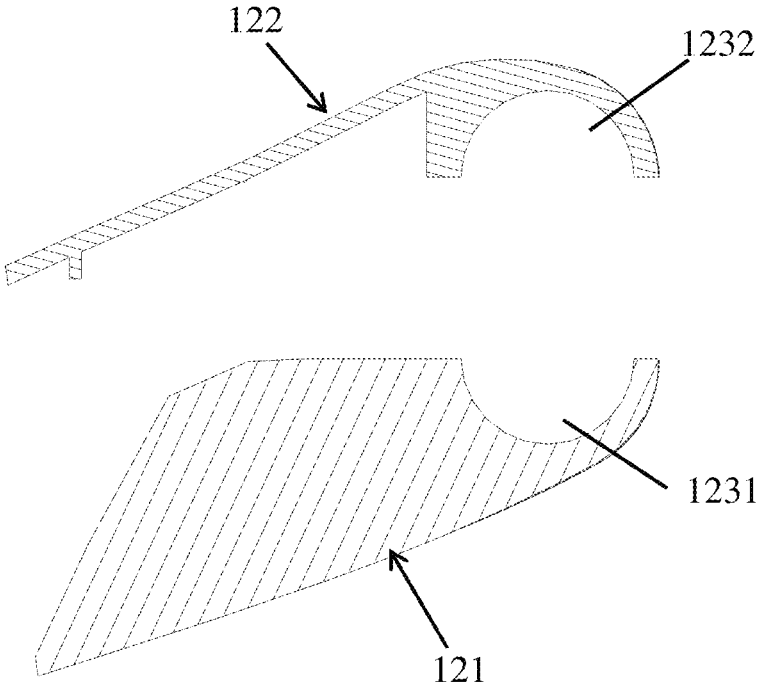
FIG. 9 is an exploded view of the mounting end upper cover and the mounting end lower cover.

In an embodiment, as shown in FIG. 3, FIG. 4, and FIG. 7, a communication channel 37 is arranged between the two water pipe mounting holes 34, and the two water pipe mounting holes 34 may share one water pipe mounting channel 36. Thus, the structure may be simplified.

In an embodiment, the plugging portion 32 is integrally formed with the assembly portion 31. The plugging portion 32 and the assembly portion 31 are rubber members and may be integrally formed by vulcanization molding and thus may have a stable structure.

In an embodiment, the flexible sealing element 3 is the silicone sealing element, and the silicone sealing element is made of a silicone material with a hardness of 60°, which not only meets a requirement of structural hardness, but also meets a requirement of sealing performance.

In an embodiment, as shown in FIG. 5, FIG. 6, FIG. 7, and FIG. 9, the seat ring mounting end 12 comprises a mounting end lower cover 121 and a mounting end upper cover 122, a rear end of the mounting end lower cover 121 is provided with an arc-shaped lower cover groove 1231, and a rear end of the mounting end upper cover 122 is provided with an arc-shaped upper cover groove 1232.

The mounting end upper cover 122 is welded with or connected to the mounting end lower cover 121, and the upper cover groove 1232 is butted with or connected to the lower cover groove 1231 to form the mounting hole 123. The mounting cavity 124 is formed between the mounting end lower cover 121 and the mounting end upper cover 122.

Accordingly, the mounting end lower cover 121 is provided with a lower cover mounting groove, and the mounting end upper cover 122 is provided with an upper cover mounting groove. When the mounting end upper cover 122 is welded with or connected to the mounting end lower cover 121, the upper cover mounting groove is butted with or connected to the lower cover mounting groove to form the mounting cavity 124.

During mounting, the wiring harness is inserted into the wiring harness assembly hole 33 through the wiring harness assembly channel 35, and the water pipe is inserted into the water pipe mounting hole 34 through the water pipe assembly channel 36. Then, the flexible sealing element 3 integrated or installed with the wiring harness and the water pipe is assembled to a designated position in the mounting end lower cover 121. Specifically, the assembly portion 31 is located in the lower cover mounting groove, and the plugging portion 32 is located in the arc-shaped lower cover groove 1231. Finally, the mounting end upper cover 122 is welded with the mounting end lower cover 121, so that the flexible sealing element 3 is assembled in place. Such a configuration may facilitate assembly and achieve a stable connection structure.

In an embodiment, as shown in FIG. 4-FIG. 7, the mounting end upper cover 122 and/or the mounting end lower cover 121 is provided with a limiting plate 125 extending into the mounting cavity 124, the assembly portion 31 is provided with a limiting groove 38, and the limiting plate 125 is inserted into the limiting groove 38. Thus, an assembly stability of the flexible sealing element 3 may be improved.

In an embodiment, the seat ring body 11 comprises a body upper cover and a body lower cover.

The mounting end upper cover 122 and the body upper cover are integrally formed into a seat ring upper cover, and the mounting end lower cover 121 and the body lower cover are integrally formed into a seat ring lower cover. The seat ring upper cover is welded with or connected to the seat ring lower cover.

In an embodiment, the seat ring 1 comprises the seat ring upper cover and the seat ring lower cover, and the seat ring upper cover is welded with or connected to the seat ring lower cover so as to have a stable structure.

The seat ring upper cover comprises the mounting end upper cover 122 and the body upper cover, and the mounting end upper cover 122 and the body upper cover are integrally formed. The seat ring lower cover comprises the mounting end lower cover 121 and the body lower cover, and the mounting end lower cover 121 and the body lower cover are integrally formed.

An embodiment of the present disclosure provides a seat ring mounting device configured to be connected to the seat ring body 11 as described. The seat ring mounting device comprises a seat ring mounting end 12 configured to be connected to the seat ring body 11. The seat ring mounting end comprises a mounting hole 123 configured to install a pivot shaft and a mounting cavity 124 connected to the mounting hole 123.

The seat ring mounting device also comprises a flexible sealing element 3 configured to be disposed in the seat ring mounting end 12. The flexible sealing element 3 comprises an assembly portion 31 configured to be disposed in the mounting cavity 124 and a plugging portion 32 connected to the assembly portion 31 and configured to seal the mounting hole 123. The plugging portion 32 comprises a wiring harness assembly hole 33 and at least one water pipe mounting hole 34 spaced apart from the wiring harness assembly hole 33.

An embodiment of the present disclosure provides a toilet comprising the seat ring 1 according to any embodiments as described above.

In an embodiment, the toilet includes a base (e.g., a pedestal, bowl, etc.) and a tank. The base is configured to be attached to another object such as a drainpipe, floor, or another suitable object. The base includes a bowl, a sump (e.g., a receptacle) disposed below the bowl, and a trapway fluidly connecting the bowl to a drainpipe or sewage line. The tank may be supported by the base, such as an upper surface of a rim. The tank may be integrally formed with the base as a single unitary body. In other embodiments, the tank may be formed separately from the base and coupled (e.g., attached, secured, fastened, connected, etc.) to the base. The toilet may further include a tank lid covering an opening and inner cavity in the tank. The toilet may include a seat assembly including a seat and a seat cover rotatably coupled to the base. The toilet may further include a hinge assembly.

In another embodiment, the toilet may be a tankless toilet. The toilet includes a base and a seat assembly coupled to the base. The base includes a bowl, a sump disposed below the bowl, and a trapway fluidly connecting the bowl to a drainpipe or sewage line. The toilet includes a waterline that supplies the toilet with water. The toilet may further include a seat assembly including a seat and a seat cover rotatably coupled to the base. The toilets described above are provided herein as non-limiting examples of toilets that may be configured to utilize aspects of the present disclosure.

In some examples, the bidet may be included in a seat or pedestal of a toilet. In other examples, the bidet may be manufactured separately from and attached or coupled to a seat or pedestal of a toilet. The bidet includes a housing. The housing is configured to receive a flow of water through a housing inlet and dispense the flow of water from a housing outlet. The housing inlet and housing outlet may be located on opposite ends of the housing from one another, such that water may flow through the housing from the housing inlet to the housing outlet. In some examples, the housing further includes a chamber. As the housing receives the flow of water, the chamber may fill with water and provide a flow of water between the housing inlet and the housing outlet. The chamber may be configured to contain the flow of water and direct the flow of water from the housing inlet to the housing outlet. After the chamber has filled with water, the flow of water may travel along a substantially linear path between the housing inlet and the housing outlet. In some examples, one or more walls within the housing may be included to help direct a flow of water between the housing inlet and the housing outlet. The bidet may further include a housing inlet conduit configured to direct a flow of water to the housing inlet. The housing inlet conduit may be coupled to a water supply such as tank or waterline. The housing may further include a gear assembly or a portion of the gear assembly.

Figure 10:
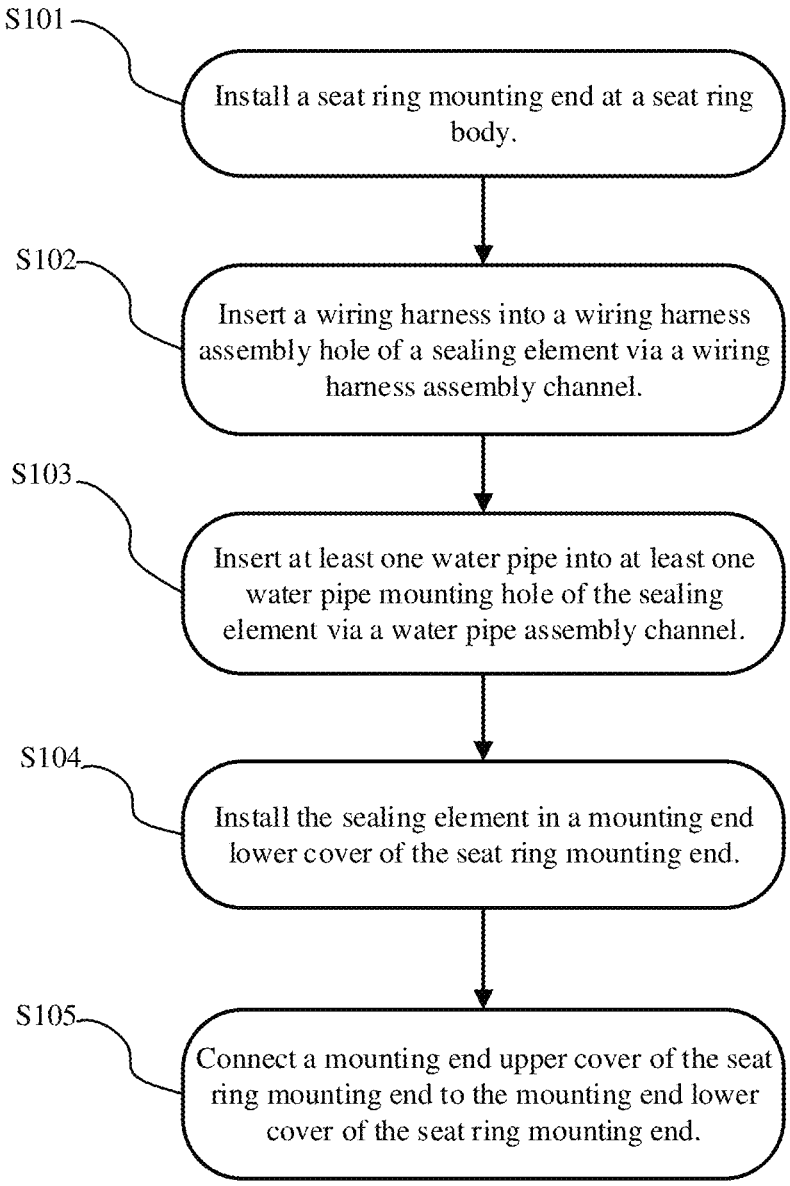
FIG. 10 is a flow chart of a method for assembling a seat ring according to an example of the present disclosure.

FIG. 10 is a flow chart of a method for assembling a seat ring according to an example of the present disclosure. The seat ring assembled by the method may be the seat ring 1 according to any of the foregoing embodiments and may be configured to perform an operation, function, or the like as described in the present disclosure.

At act S101, a user may install the seat ring mounting end 12 at the seat ring body 11. As noted above, the seat ring mounting end 12 comprises the mounting hole 123 configured to mount a pivot shaft and comprises the mounting cavity 124 communicated to the mounting hole 123.

At act S102, the user may insert the wiring harness into the wiring harness assembly hole 33 of the flexible sealing element 3 via the wiring harness assembly channel 35. As noted above, the wiring harness assembly channel 35 is arranged between a surface of the plugging portion 32 and the wiring harness assembly hole 33. The opening of the wiring harness assembly channel 35 is located at the rear end of the plugging portion 32.

At act S103, the user may insert the at least one water pipe into the at least one water pipe mounting hole 34 of the flexible sealing element 3 via the water pipe assembly channel 36. As noted above, the water pipe assembly channel 36 is arranged between an outer surface of the plugging portion 32 (or the same surface where the wiring harness assembly channel 35 is disposed) and the water pipe mounting hole 34.

In an embodiment, a hot water pipe and a cold water pipe may be respectively installed in two water pipe mounting holes 34. The communication channel 37 is arranged between the two water pipe mounting holes 34. Thus, the user may insert one of the hot water pipe and the cold water pipe into one of the two water pipe mounting holes 34 via the water pipe assembly channel 36 and the communication channel 37.

At act S104, the user may install the flexible sealing element 3 in the mounting end lower cover 121 of the seat ring mounting end 12. As noted above, the flexible sealing element 3 comprises the assembly portion 31 and the plugging portion 32. The plugging portion 32 comprises the wiring harness assembly hole 33 and the at least one water pipe mounting hole 34. The rear end of the mounting end lower cover 121 is provided with the arc-shaped lower cover groove 1231. Thus, the user may install the plugging portion 32 in the arc-shaped lower cover groove 1231. The mounting end lower cover 121 is provided with the lower cover mounting groove. Thus, the user may install the assembly portion 31 in the lower cover mounting groove.

At act S105, the user may connect the mounting end upper cover 122 of the seat ring mounting end to the mounting end lower cover 121 of the seat ring mounting end 12. As noted above, the rear end of the mounting end upper cover 122 is provided with the arc-shaped upper cover groove 1232. The mounting end upper cover 122 is provided with an upper cover mounting groove. Thus, when the mounting end upper cover 122 is welded with or connected to the mounting end lower cover 121, the upper cover groove 1232 is butted with or connected to the lower cover groove 1231 to form the mounting hole 123, and the upper cover mounting groove is butted with or connected to the lower cover mounting groove to form the mounting cavity 124.

The acts in the method for assembling the seat ring may be performed in any sequences.

In the present disclosure, the flexible sealing element 3 (e.g., a rubber sealing element or a silicone sealing element) is used in the above embodiments. However, a non-flexible sealing element 3 may also be used in the present disclosure.

The above technical solutions may be combined as required to achieve the best technical effect.

The above description is merely the principle and the embodiments of the present disclosure. It should be pointed out that, for those of ordinary skill in the art, several other modifications may be made based on the principle of the present disclosure and should also be regarded as falling within the protection scope of the present disclosure.

I claim:

1. A toilet seat ring, comprising:

a seat ring body;

a seat ring mounting end configured to be connected to the seat ring body, the seat ring mounting end comprising:

a mounting hole configured to install a pivot shaft; and a mounting cavity connected to the mounting hole; and a sealing element configured to be disposed in the seat ring mounting end, the sealing element comprising:

an assembly portion configured to be disposed in the mounting cavity; and a plugging portion connected to the assembly portion and configured to seal the mounting hole, the plugging portion comprising a wiring harness assembly hole and at least one water pipe mounting hole spaced apart from the wiring harness assembly hole.

2. The toilet seat ring according to claim 1, further comprising:

a wiring harness assembly channel connecting a surface of the plugging portion and the wiring harness assembly hole; and a water pipe assembly channel connecting between the surface of the plugging portion and the water pipe mounting hole.

3. The toilet seat ring according to claim 2, wherein openings of the wiring harness assembly channel and the water pipe assembly channel are both disposed at a rear end of the plugging portion.

4. The toilet seat ring according to claim 1, wherein the at least one water pipe mounting hole comprises two water pipe mounting holes spaced apart from each other.

5. The toilet seat ring according to claim 4, wherein a communication channel is connected between the two water pipe mounting holes.

6. The toilet seat ring according to claim 1, wherein the plugging portion is integrally formed with the assembly portion.

7. The toilet seat ring according to claim 1, wherein the sealing element is a flexible sealing element comprising a silicone sealing element.

8. The toilet seat ring according to claim 1, wherein the seat ring mounting end comprises:

a mounting end lower cover comprising an arc-shaped lower cover groove disposed at a rear end of the mounting end lower cover; and a mounting end upper cover comprising an arc-shaped upper cover groove disposed at a rear end of the mounting end upper cover, and wherein when the mounting end upper cover is connected to the mounting end lower cover, the mounting cavity is formed between the mounting end upper cover and the mounting end lower cover, and the mounting hole is formed between the upper cover groove and the lower cover groove.

9. The toilet seat ring according to claim 8, wherein the assembly portion comprises a limiting groove, wherein the mounting end upper cover or the mounting end lower cover comprises a limiting plate extending into the mounting cavity, and wherein a limiting plate is configured to be inserted into the limiting groove.

10. The toilet seat ring according to claim 8, wherein the seat ring body comprises a body upper cover and a body lower cover, wherein the mounting end upper cover and the body upper cover are integrally formed into a seat ring upper cover, wherein the mounting end lower cover and the body lower cover are integrally formed into a seat ring lower cover, and wherein the seat ring upper cover is connected to the seat ring lower cover.

11. The toilet seat ring according to claim 1, wherein the at least one water pipe mounting hole is disposed below the wiring harness assembly hole.

12. A seat ring mounting device, comprising:

a seat ring mounting end configured to be connected to a seat ring body, the seat ring mounting end comprising:

a mounting hole configured to install a pivot shaft; and a mounting cavity connected to the mounting hole; and a sealing element configured to be disposed in the seat ring mounting end, the sealing element comprising:

an assembly portion configured to be disposed in the mounting cavity; and a plugging portion connected to the assembly portion and configured to seal the mounting hole, the plugging portion comprising a wiring harness assembly hole and at least one water pipe mounting hole spaced apart from the wiring harness assembly hole.

13. The seat ring mounting device according to claim 12, wherein the at least one water pipe mounting hole comprises two water pipe mounting holes spaced apart from each other, and wherein a communication channel is connected between the two water pipe mounting holes.

14. The seat ring mounting device according to claim 12, wherein the seat ring mounting end comprises:

a mounting end lower cover comprising an arc-shaped lower cover groove disposed at a rear end of the mounting end lower cover; and a mounting end upper cover comprising an arc-shaped upper cover groove disposed at a rear end of the mounting end upper cover, and wherein when the mounting end upper cover is connected to the mounting end lower cover, the mounting cavity is formed between the mounting end upper cover and the mounting end lower cover, and the mounting hole is formed between the upper cover groove and the lower cover groove.

15. The seat ring mounting device according to claim 14, wherein the assembly portion comprises a limiting groove, wherein the mounting end upper cover or the mounting end lower cover comprises a limiting plate extending into the mounting cavity, and wherein a limiting plate is configured to be inserted into the limiting groove.

16. A method for assembling a toilet seat ring, the method comprising:

installing a seat ring mounting end at a seat ring body;

inserting a wiring harness into a wiring harness assembly hole of a sealing element via a wiring harness assembly channel;

inserting at least one water pipe into at least one water pipe mounting hole of the sealing element via a water pipe assembly channel;

installing the sealing element in a mounting end lower cover of the seat ring mounting end; and connecting a mounting end upper cover of the seat ring mounting end to the mounting end lower cover of the seat ring mounting end.

17. The method according to claim 16, wherein the installing the sealing element in the mounting end lower cover of the seat ring mounting end comprises:

installing a plugging portion, comprising the wiring harness assembly hole and the at least one water pipe mounting hole, of the sealing element in a mounting hole; and installing an assembly portion of the sealing element in a mounting cavity of the seat ring mounting end by inserting a limiting plate of the mounting end upper cover of the seat ring mounting end or the mounting end lower cover of the seat ring mounting end into a limiting groove of the assembly portion, wherein the mounting hole and the mounting cavity are formed by connecting the mounting end upper cover of the seat ring mounting end to the mounting end lower cover of the seat ring mounting end.

18. The method according to claim 16, further comprising:

wherein the at least one water pipe mounting hole comprises two water pipe mounting holes connected with each other via a communication channel, wherein the at least one water pipe comprises a hot water pipe and a cold water pipe, and wherein the inserting the at least one water pipe into the at least one water pipe mounting hole of the sealing element via the water pipe assembly channel comprises:

inserting one of the hot water pipe and the cold water pipe into one of the two water pipe mounting holes via the water pipe assembly channel and the communication channel.

19. The method according to claim 16, wherein the sealing element is a flexible sealing element, wherein a width of the wiring harness assembly channel is smaller than a diameter of the wiring harness assembly hole, wherein the inserting the wiring harness into the wiring harness assembly hole of the sealing element via the wiring harness assembly channel comprises:

expanding the width of the wiring harness assembly channel when inserting the wiring harness.

20. The method according to claim 16, wherein the sealing element is a flexible sealing element, wherein a width of the water pipe assembly channel is smaller than a diameter of the at least one water pipe mounting hole, wherein the inserting the at least one water pipe into the at least one water pipe mounting hole of the sealing element via the water pipe assembly channel comprises:

expanding the width of the water pipe assembly channel when inserting the at least one water pipe.

* * * * *